US012617598B2

(12) United States Patent
Yuan

(10) Patent No.: US 12,617,598 B2
(45) Date of Patent: May 5, 2026

(54) COMBINED DOUBLE-LAYER BUFFERING MODULAR CONCAVE CORNER PROTECTOR

(71) Applicant: NINGBO ANSOL CABINET CO., LTD., Ningbo (CN)

(72) Inventor: Limin Yuan, Ningbo (CN)

( * ) Notice: Subject to any disclaimer, the term of this patent is extended or adjusted under 35 U.S.C. 154(b) by 0 days.

(21) Appl. No.: 18/662,213

(22) Filed: May 13, 2024

(65) Prior Publication Data

US 2025/0197080 A1 Jun. 19, 2025

(30) Foreign Application Priority Data

Dec. 15, 2023 (CN) ..... 202311738824.4

(51) Int. Cl.
*B65D 81/05* (2006.01)

(52) U.S. Cl.
CPC ..... *B65D 81/057* (2013.01)

(58) Field of Classification Search
CPC .... B65D 81/057; B65D 81/054; B65D 85/48; B65D 57/006; B65D 67/02
USPC ..... 206/586, 453, 454
See application file for complete search history.

(56) References Cited

U.S. PATENT DOCUMENTS 5,423,428 A * 6/1995 Selz ..... B60P 7/0869 206/386
8,109,393 B2 * 2/2012 Haeberlein ..... H02S 20/23 211/41.14
8,561,801 B2 * 10/2013 Grenchus, Jr. ..... B65D 81/056 206/453
8,991,602 B2 * 3/2015 Kashima ..... B65D 85/30 211/49.1
9,669,985 B1 * 6/2017 Hudson ..... H10F 77/00
12,162,676 B1 * 12/2024 Day ..... B65D 90/20
2012/0305444 A1 * 12/2012 Fujita ..... B65D 81/056 206/701
2014/0360899 A1 * 12/2014 Huang ..... B65D 21/0219 206/278
2015/0360836 A1 * 12/2015 Shi ..... B65D 85/48 206/316.1
2024/0400277 A1 * 12/2024 Wu ..... B65D 85/48

* cited by examiner

*Primary Examiner* — Steven A. Reynolds

(57) ABSTRACT

A combined double-layer buffering modular concave corner protector, relating to technical field of packaging products. It includes modular corner protectors, and at least two modular corner protectors are provided, affixed to each other and locked by screws and nuts; a groove for assembling product is provided between two modular corner protectors, and a cavity is provided inside the modular corner protector. By combining the modular corner protectors two by two to form a groove, grooves of different sizes can be obtained by adjusting thickness of the first convex platform and second convex platform to protect corners of flat-panel products with a variety of thickness specifications; using screws to fit with nuts to fix two modular corner protectors and firmly press product corner so as to ensure that the product is not easy to fall off in transportation process without use of tape or packing strap.

8 Claims, 4 Drawing Sheets

COMBINED DOUBLE-LAYER BUFFERING MODULAR CONCAVE CORNER PROTECTOR

1. TECHNICAL FIELD

The invention relates to the technical field of packaging products, in particular to a combined double-layer buffering modular concave corner protector.

2. BACKGROUND ART

Corner protector, also known as edge board, is one of the popular packaging products and used to replace wood packaging and other bulky packaging methods, which is also known as paper wrapped corners or corner protection paper board, edge board, corner paper, and paper angle bead; it's formed by the bobbin paper and kraft paper via shaping and pressing of complete set of corner protector machine, the current transport package on the market for flat panel products such as ceramic tiles, floor tiles, sintered stones, glass, doors and windows, displays, LCD televisions, and furniture of flat panel mainly adopt single-wall plastic corner protector packaging or foam corner protector to package and protect corner edges, and most of such products are very heavy, the corners are very sharp, and foam packaging is easy to be crushed or pierced, so most of single-wall plastic concave corner protectors at present are adopted to cover the corner of products to protect products from being damaged.

But single-wall plastic concave corner protector has the following fatal defects:

1. It does not have cushioning effect, since there is no cushioning effect to reduce the collision force, almost all the striking force after collision is transmitted to the product without any loss, and corners of the product are also prone to be damaged in the transportation and carrying process;
2. The concave corner can not clamp product corners tightly, effect of which is still undesirable even with the help of tape wrapping or packing strap strapping, and some large products can not be packaged.

3. SUMMARY OF THE INVENTION

In order to realize above purpose, the invention provides the following technical scheme: a combined double-layer buffering modular concave corner protector, comprising modular corner protectors, and at least two modular corner protectors are provided, which are affixed to each other and locked by screws and nuts; a groove for assembling product is provided between two modular corner protectors, and cavities are provided inside the modular corner protectors;

The modular corner protector includes a corner protector body and a first convex platform and a second convex platform provided on two sides of the corner protector body respectively, and two sides of corner protector body are provided with first anti-slip convex ribs.

As a preferred technical solution of the invention, the corner protector body is integrally molded with the first convex platform and second convex platform on both sides thereof.

As a preferred technical solution of the invention, the corner protector body is square as a whole, and length and width dimensions of the corner protector body are the same.

As a preferred technical solution of the invention, second anti-slip convex ribs are provided on edges of back side of the first convex platform and second convex platform.

As a preferred technical solution of the invention, third anti-slip convex ribs are provided on edges of two sides of the corner protector body.

As a preferred technical solution of the invention, both ends of the first anti-slip convex ribs and third anti-slip convex ribs extend to the second anti-slip convex ribs.

As a preferred technical solution of the invention, interior of the corner protector body is provided with through holes for installing screws, both ends of the through holes are provided with hexagonal holes, and the hexagonal holes are used for installing screw heads or nuts.

As a preferred technical solution of the invention, circular dodge holes are provided at one end of the hexagonal holes away from the through holes.

As a preferred technical solution of the invention, a notch is provided on one corner of the corner protector body.

As a preferred technical solution of the invention, buffering grooves with two ends extending to the first convex platform and second convex platform respectively are provided on two side edges of the corner protector body away from the notch.

Compared with the prior art, the invention provides a combined double-layer buffering modular concave corner protector, which has the following advantages:

The combined double-layer buffering modular concave corner protector, by combining the modular corner protectors two by two to form a groove, grooves of different sizes can be obtained by adjusting thickness of the first convex platform and second convex platform, so as to protect corners of flat panel products with a variety of thickness specifications on the market; the use of screws to fit with nuts to fix two modular corner protectors and firmly press corner of the product at the same time, so as to ensure that the product is not easy to fall off in transportation process without use of tape wrapping or packing strap strapping; the structure is streamlined to facilitate processing and production, which has a broad application prospect.

4. BRIEF DESCRIPTION OF ACCOMPANY DRAWINGS

As shown in the accompanying drawings: 1 modular corner protector, 101 corner protector body, 1011 notch, 1012 buffering groove, 102 first convex platform, 103 second convex platform, 104 first anti-slip convex rib, 105 second anti-slip convex rib, 106 third anti-slip convex rib,

107 through hole, 108 hexagonal hole, 109 circular dodge hole, 2 screw, 3 nut, 4 groove.

5. SPECIFIC EMBODIMENT OF THE INVENTION

The technical scheme of the invention is further described clearly and detailedly hereinafter with reference to drawings. Obviously, only partial embodiments of the invention are shown and the actual structure is not limited thereto. All other embodiments, which can be obtained by those skilled in the art without making any creative effort based on the embodiments in the present invention, shall all fall within the protective scope of the invention.

Figure 1:
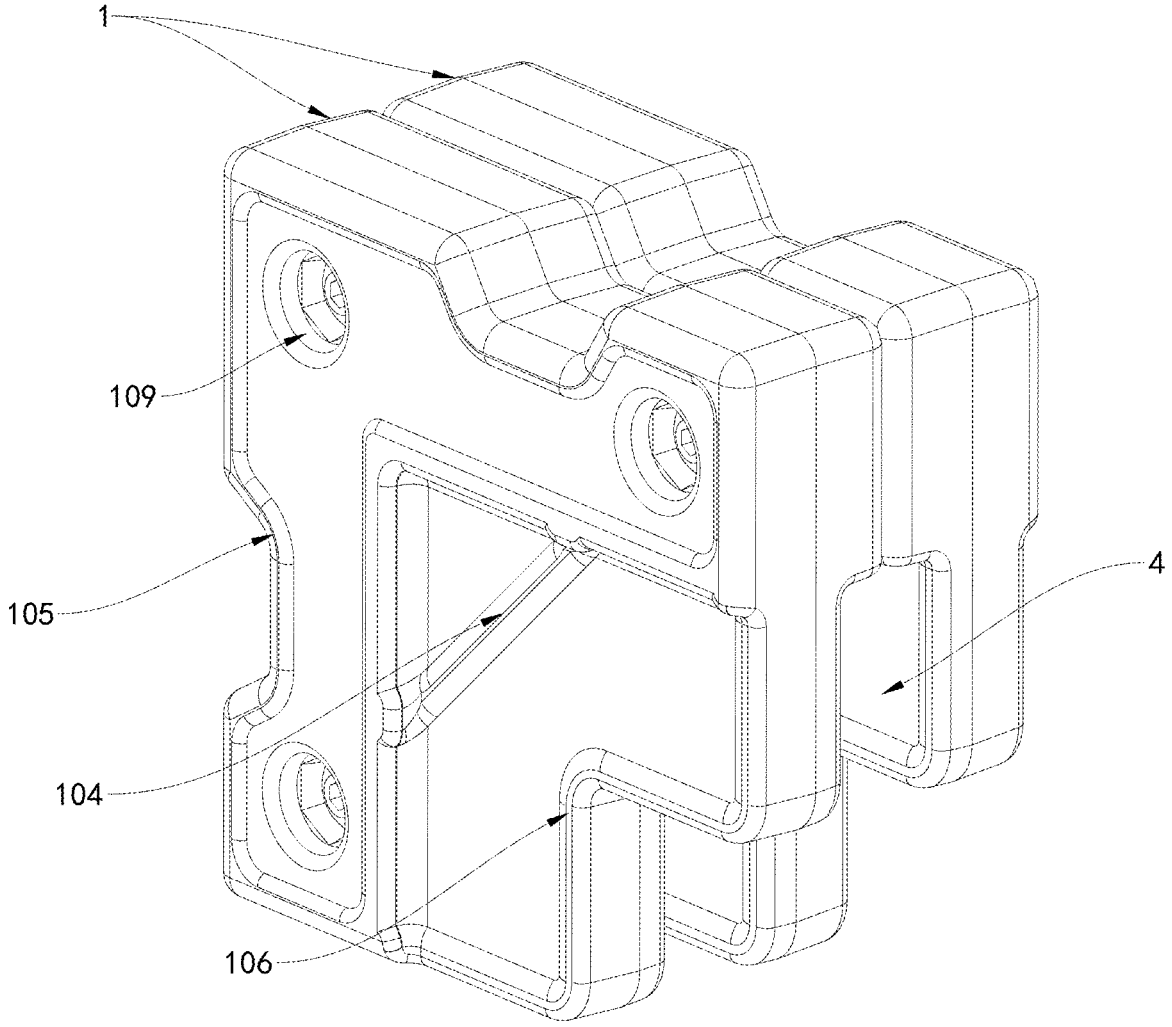
FIG. 1 is structural diagram of the combined double-layer buffering modular concave corner protector provided by the invention.
Figure 2:
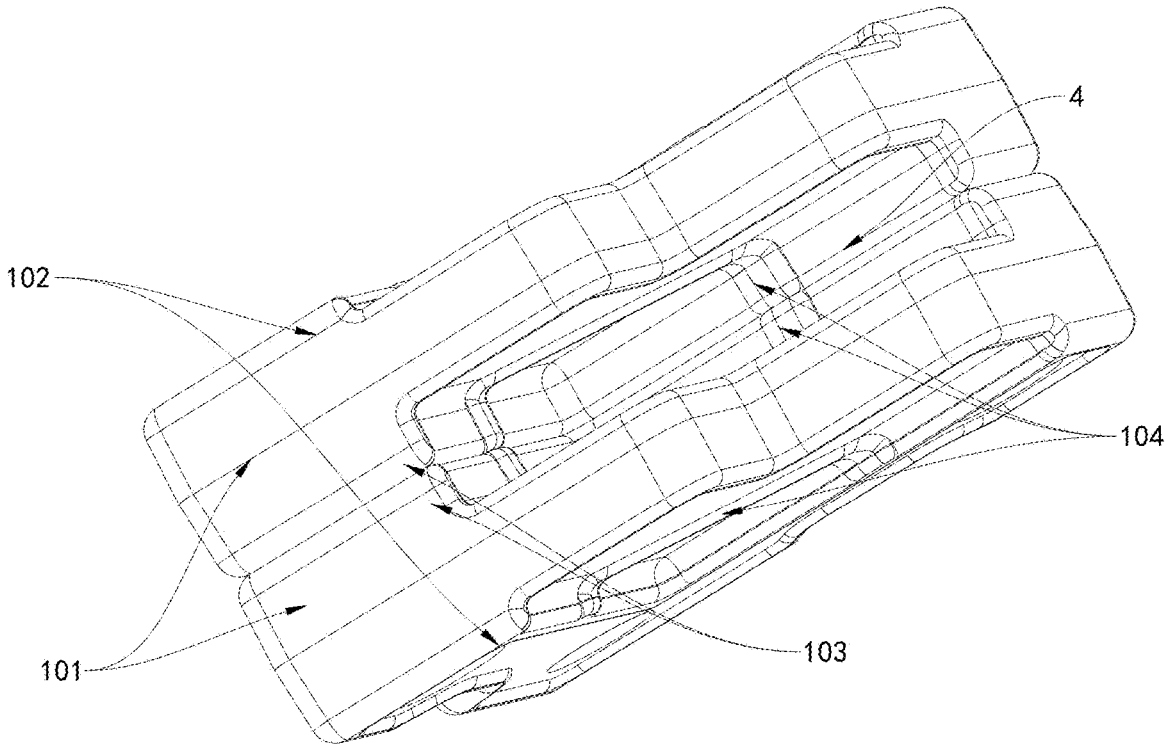
FIG. 2 is structural diagram of groove of combined double-layer buffering modular concave corner protector provided by the invention.
Figure 3:
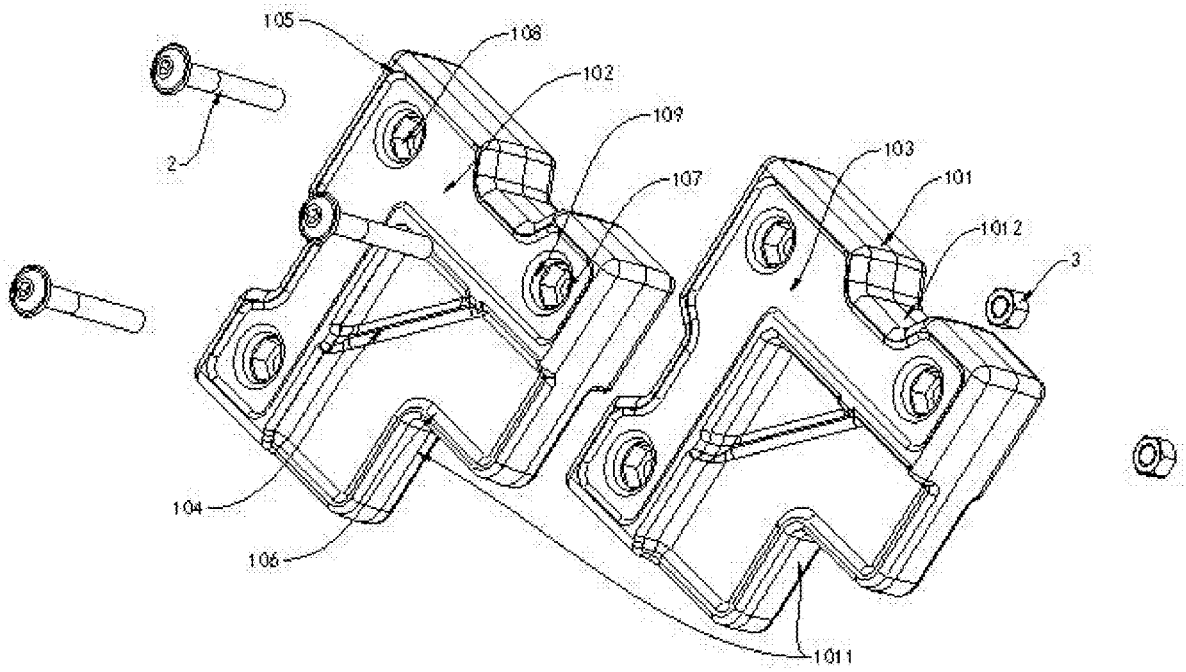
FIG. 3 is exploded view of the modular corner protectors of combined double-layer buffering modular concave corner protector provided by the invention.
Figure 4:
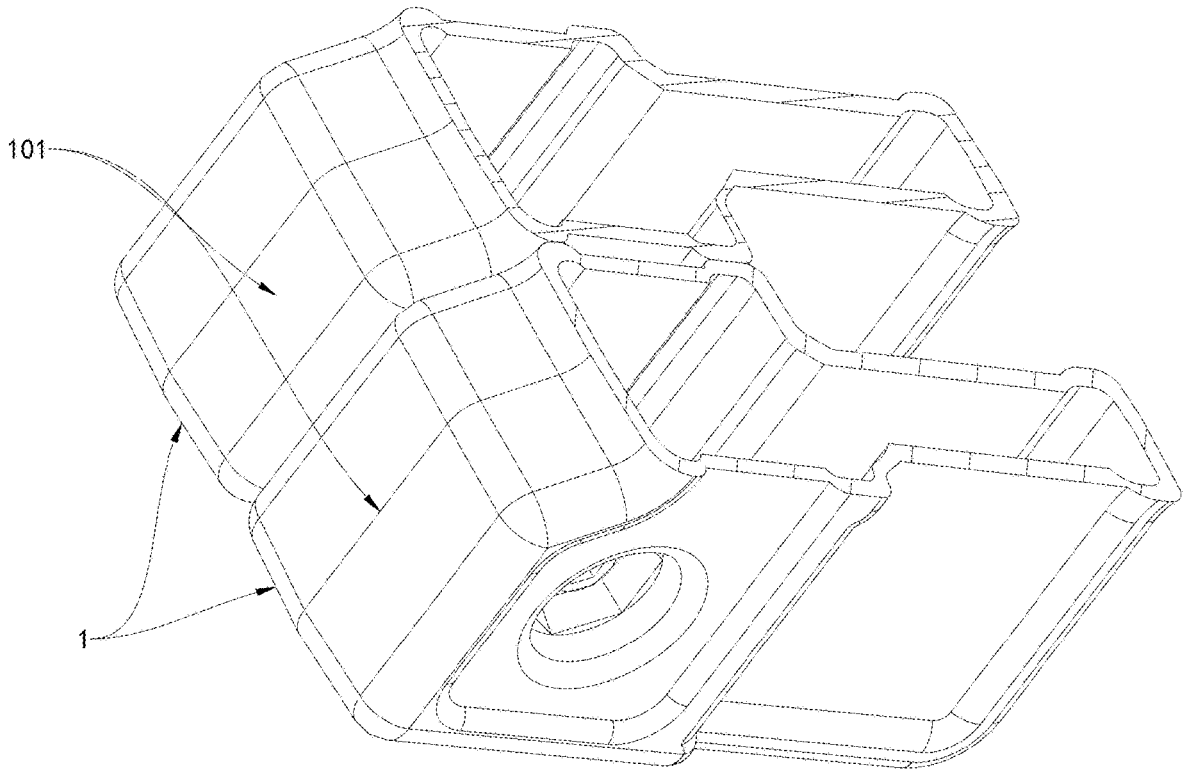
FIG. 4 is sectional view of the modular corner protectors of combined double-layer buffering modular concave corner protector provided by the invention.

Embodiment 1, with reference to FIGS. 1 to 4, a combined double-layer buffering modular concave corner protector, comprising modular corner protectors 1, and at least two modular corner protectors 1 are provided, which are affixed to each other and locked by screws 2 and nuts 3; a groove 4 for assembling product is provided between two modular corner protectors 1, and cavities are provided inside the modular corner protector 1; with reference to FIG. 4, cavities in closed state are provided inside the modular corner protectors 1.

The modular corner protector 1 includes a corner protector body 101 and a first convex platform 102 and second convex platform 103 provided on two sides of the corner protector body 101 respectively, and two sides of the corner protector body 101 are provided with first anti-slip convex ribs 104.

As a preferred technical solution of the invention, the corner protector body 101 is integrally molded with the first convex platform 102 and second convex platform 103 on both sides thereof, which can be formed by blow molding or mold shaping. After the modular corner protector 1 is molded, a closed cavity is formed inside thereof for cushioning the striking force.

As a preferred technical solution of the invention, the corner protector body 101 is square as a whole, and length and width dimensions of the corner protector body 101 are the same; this design not only saves processing materials and maximizes protection of the product, but also facilitates combination of two modular corner protectors 1 and ensures the appearance after combination.

As a specific technical solution of the embodiment, second anti-slip convex ribs 105 are provided on edges of back side of the first convex platform 102 and second convex platform 103; arrangement of second anti-slip convex ribs 105 increases friction between the modular corner protector 1 and outer packaging material, reduces shaking, and ensures stability of the modular corner protector 1. At the same time, a cushioning space will be formed in interior of second anti-slip convex ribs 105, which further ensures cushioning and protection effect of the modular corner protector 1.

As a specific technical solution of the embodiment, third anti-slip convex ribs 106 are provided on edges of two sides of the corner protector body 101, and both ends of the first anti-slip convex ribs 104 and third anti-slip convex ribs 106 extend to the second anti-slip convex ribs 105; the third anti-slip convex ribs 106 and first anti-slip convex ribs 104 serve the same purpose, both of which increase friction with the product, and when the product is clamped to inside of the groove 4, the first anti-slip convex ribs 104 and third anti-slip convex ribs 106 contact with the product, which are not smooth planes, ensuring stability of the modular corner protectors 1 and product assembly, and at the same time, due to hollowing arrangement of the first anti-slip convex ribs 104 and second anti-slip convex ribs 105, buffering space will be shaped between inner wall of the groove 4 and the product, which further reduces collision damage to the product.

As a specific technical solution of the embodiment, interior of the corner protector body 101 is provided with through holes 107 for installing screws 2, both ends of the through holes 107 are provided with hexagonal holes 108, and the hexagonal holes 108 are used for installing screw heads or nuts 3; circular dodge holes 109 are provided at one end of the hexagonal holes 108 away from the through holes 107; when used, two modular corner protectors 1 are arranged opposite to each other, firstly put the nuts 3 into hexagonal holes 108 of one modular corner protector 1, use the screws 2 to pass through circular dodge holes 109 of the other modular corner protector 1 and screwed into the nuts 3, partially screwed into the nut 3 can be efficient; corner of the product is stuck by two initially combined modular corner protectors 1 through the groove 4, continuing to screw the screw 2 to make two modular corner protectors 1 more close to and fasten the product firmly, in the screw head 2 is provided with an internal hexagonal groove, and the screw 2 can be screwed through the hexagon key.

As a specific technical solution of the embodiment, a notch 1011 is provided on one corner of the corner protector body 101. The notch 1011 is provided to reduce the amount of material to be processed for the modular corner protector 1, while facilitating clamping of the groove 4 to the product.

As a specific technical solution of the embodiment, buffering grooves 1012 with two ends extending to the first convex platform 102 and second convex platform 103 respectively are provided on two side edges of the corner protector body 1 away from the notch 1011. The arrangement of buffering grooves 1012 reduces the processing material and increase the friction between two side edges of the corner protector body 101 away from the notch 1011 and outer packaging material, which further ensures the stability of use.

As a specific technical solution of the embodiment, in the embodiment, thickness of the first convex platform 102 is smaller than the thickness of the second convex platform 103, and after symmetrically affixing two modular corner protectors 1 via the second convex platform 103, thickness of groove 4 between two modular corner protectors 1 is larger.

Figure 5:
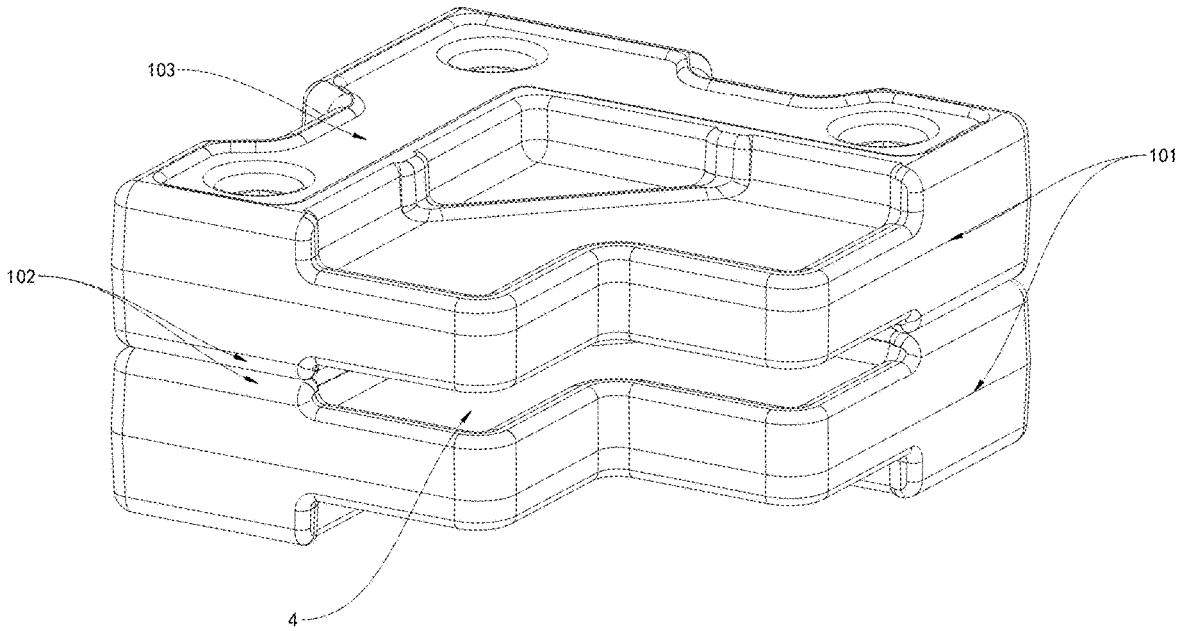
FIG. 5 is structural diagram of embodiment 2 of combined double-layer buffering modular concave corner protector provided by the invention.

Embodiment 2, referring to FIG. 5, compared to the above embodiment, in this embodiment, thickness of the groove 4 between two modular corner protectors 1 is smaller after symmetrically affixing two modular corner protectors 1 via the first convex platform 102.

Figure 6:
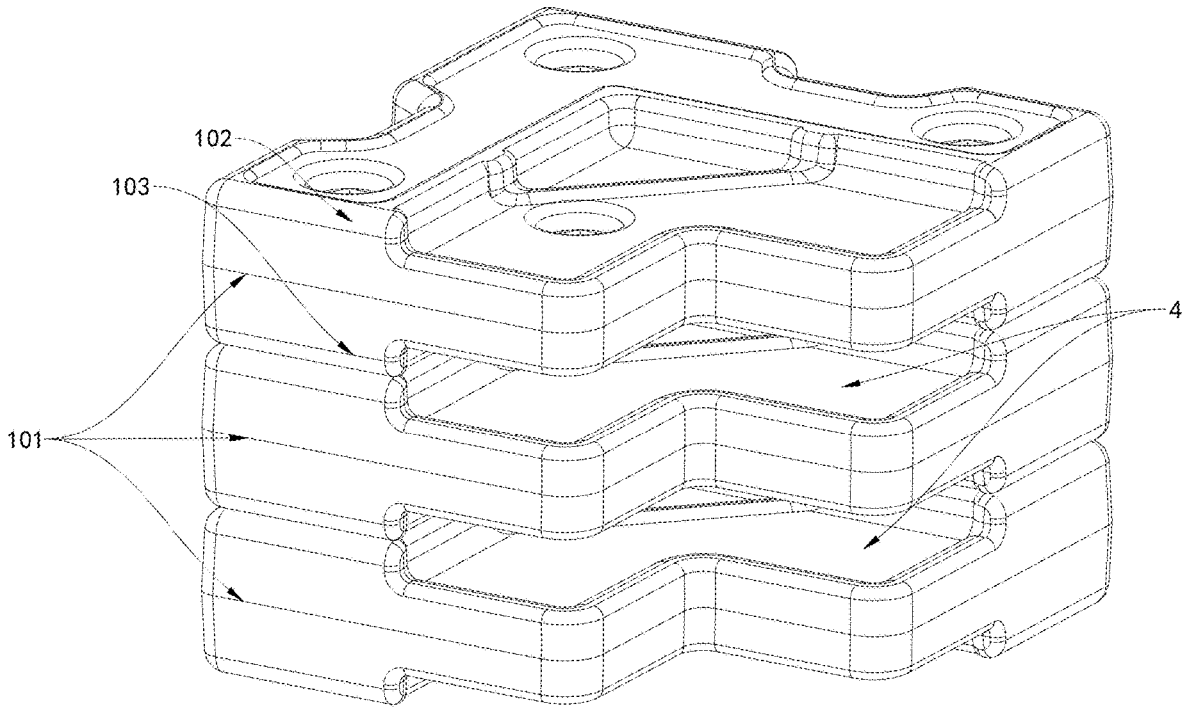
FIG. 6 is structural diagram of embodiment 3 of combined double-layer buffering modular concave corner protector provided by the invention.

Embodiment 3, referring to FIG. 6, compared to the above embodiment, in this embodiment, thickness of the corner protector body 101 remains the same, and thickness of the first convex platform 102 and second convex platform 103 is the same, which is designed in such a way that after symmetrically affixing two modular corner protectors 1 by means of either first convex platform 102 or second convex platform 103, thickness of groove 4 between two modular corner protectors 1 is the same, and in this embodiment, thickness of groove 4 is between thickness of groove 4 in embodiment 2 and that in embodiment 1; when thickness of the first convex platform 102 and second convex platform 103 is the same, using a combination of more than two modular corner protectors 1, thickness of groove 4 between plurality of modular corner protectors 1 is the same, and only size of screws 2 need to be lengthened.

Figure 7:
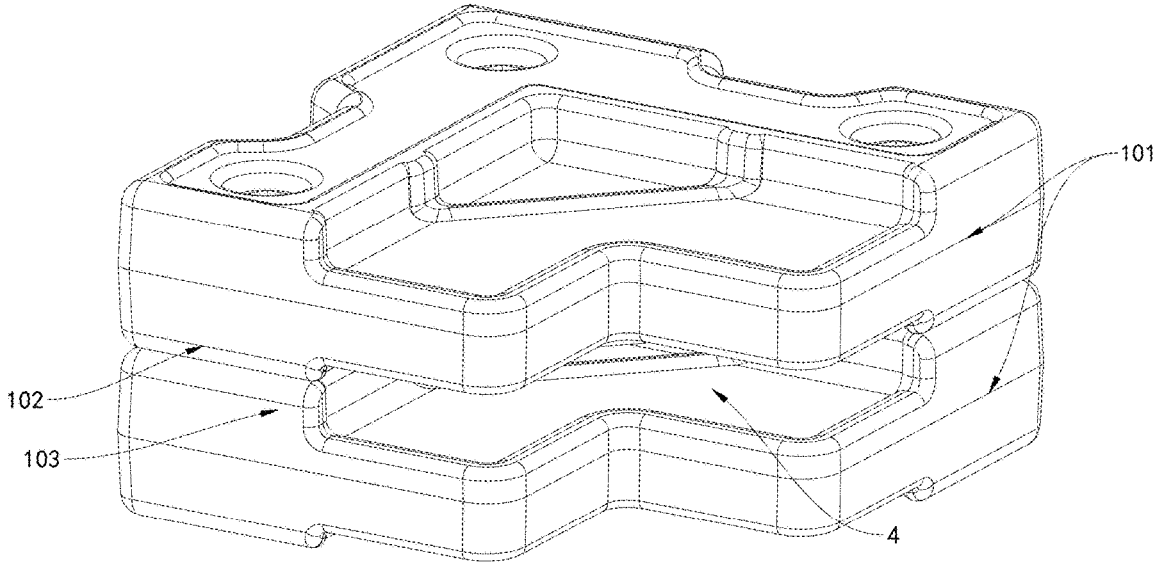
FIG. 7 is structural diagram of the embodiment 4 of combined double-layer buffering modular concave corner protector provided by the invention.

Embodiment 4, referring to FIG. 7, in this embodiment, after affixing two modular corner protectors 1 via the first convex platform 102 and the second convex platform 103, thickness of groove 4 between two modular corner protectors 1 is different from thickness of groove 4 in above three embodiments; this embodiment and three embodiments described above provide a total of four kinds of thickness of groove 4, but are not limited to the four kinds described above, and by changing thicknesses of first convex platform 102 and second convex platform 103, without changing thickness of the corner protector body 101, and then combining two modular corner protectors through convex platform 102 and second convex platform 103 with different thicknesses randomly, a variety of dimensions of groove 4 can be obtained, which has been adapted to fit dimensions of different products such as ceramic tiles, floor tiles, sintered stones, glass, doors and windows, displays, LCD televisions, and furniture of flat panel, and other flat panel products.

In conclusion, the combined double-layer buffering modular concave corner protector, by combining the modular corner protectors two by two to form a groove 4, grooves 4 of different sizes can be obtained by adjusting thickness of the first convex platform 102 and second convex platform 103, so as to protect corners of flat panel products with a variety of thickness specifications on the market; the use of screws 2 to fit with nuts 3 to fix two modular corner protectors 1 and firmly press corner of the product at the same time, so as to ensure that the product is not easy to fall off in transportation process without use of tape wrapping or packing strap strapping; the structure is streamlined to facilitate processing and production, which has a broad application prospect.

It should be noted that, as used herein, terms such as "including", "comprising", or any other variant thereof, are intended to encompass non-exclusive inclusion, such that a process, method, article, or apparatus comprising a set of elements includes not only those elements, but also other elements that are not explicitly listed, or that are inherent to such process, method, article, or apparatus. includes other elements that are not expressly listed or that are inherent to such process, method, article or apparatus. Without further limitation, the fact that an element is defined by the phrase "includes a . . . " does not preclude the existence of additional identical elements in the process, method, article or apparatus that includes the element.

The invention and its embodiments have been described above, but the description is not limited thereto; only one embodiment of the invention is shown in the drawings, and the actual structure is not limited thereto. In general, it is to be understood by those skilled in the art that non-creative design of structural forms and embodiments that are similar to the technical solutions without departing from the spirit of the invention shall all fall within the protective scope of the invention.

The invention claimed is:

1. A combined double-layer buffering modular concave corner protector, comprising modular corner protectors, and at least two modular corner protectors are provided, which are affixed to each other and locked by screws and nuts; a groove for assembling product is provided between two modular corner protectors, and cavities are provided inside the modular corner protectors;

each modular corner protector includes a corner protector body and a first convex platform and second convex platform provided on two sides of the corner protector body respectively, and two sides of said corner protector body are provided with first anti-slip convex ribs;

wherein a notch is provided on one corner of said corner protector body, buffering grooves with two ends extending to the first convex platform and second convex platform respectively are provided on two side edges of said corner protector body away from the notch.

2. The combined double-layer buffering modular concave corner protector of claim 1, wherein said corner protector body is integrally molded with the first convex platform and second convex platform on both sides thereof.

3. The combined double-layer buffering modular concave corner protector of claim 1, wherein said corner protector body is square as a whole, and the length and width dimensions of said corner protector body are the same.

4. The combined double-layer buffering modular concave corner protector of claim 1, wherein second anti-slip convex ribs are provided on edges of a back side of said first convex platform and second convex platform.

5. The combined double-layer buffering modular concave corner protector of claim 4, wherein third anti-slip convex ribs are provided on edges of two sides of said corner protector body.

6. The combined double-layer buffering modular concave corner protector of claim 5, wherein both ends of said first anti-slip convex ribs and third anti-slip convex ribs extend to the second anti-slip convex ribs.

7. The combined double-layer buffering modular concave corner protector of claim 1, wherein an interior of said corner protector body is provided with through holes for installing screws, both ends of said through holes are provided with hexagonal holes, and said hexagonal holes are used for installing screw heads or nuts.

8. The combined double-layer buffering modular concave corner protector of claim 7, wherein circular dodge holes are provided at one end of said hexagonal holes away from the through holes.

* * * * *